United States Patent [19]

Desiderio

[11] Patent Number: 4,470,596

[45] Date of Patent: Sep. 11, 1984

[54] EXERCISE WEIGHT-LIFTING APPARATUS AND IMPROVED CARRIAGE FOR SAME

[76] Inventor: Ron Desiderio, 3 Willow Park Center, Farmingdale, N.Y. 11735

[21] Appl. No.: 454,496

[22] Filed: Dec. 29, 1982

[51] Int. Cl.[3] ..... A63B 21/06

[52] U.S. Cl. ..... 272/118; 272/143; 272/134

[58] Field of Search ..... 272/118, 134, 143, 142, 272/93

[56] References Cited

U.S. PATENT DOCUMENTS

| | | | |
|---|---|---|---|
| Re. 28,066 | 7/1974 | Marcyan | 272/118 |
| 3,635,472 | 1/1972 | Marcyan | 272/118 |
| 3,912,263 | 10/1975 | Yatso | 272/118 |
| 3,971,555 | 7/1976 | Mahnke | 272/118 |
| 4,010,947 | 3/1977 | Lambert | 272/118 |
| 4,200,280 | 4/1980 | Goodwin | 272/118 |
| 4,208,049 | 6/1980 | Wilson | 272/143 X |
| 4,317,566 | 3/1982 | Uyeda et al. | 272/118 |
| 4,339,125 | 7/1982 | Uyeda et al. | 272/118 |
| 4,346,888 | 8/1982 | Szabo | 272/118 |

*Primary Examiner*—Richard J. Apley
*Assistant Examiner*—William R. Browne
*Attorney, Agent, or Firm*—Bauer & Amer

[57] ABSTRACT

An exercising and body-building apparatus of the type in which a carriage having weights suspended therefrom is urged through ascending movement along guide rods during exercising use thereof, wherein a handle attachment of the carriage is vertically adjustable so that the exerciser can more conveniently use the apparatus in either prone or standing position. Also significant is the use of linear bearings in the carriage which obviates binding during the ascending carriage movement, even when the handle is in its most remote adjusted position from the carriage and thus exhibits the greatest tendency to cause a rotative movement in the carriage.

2 Claims, 6 Drawing Figures

EXERCISE WEIGHT-LIFTING APPARATUS AND IMPROVED CARRIAGE FOR SAME

The present invention relates generally to improvements for an exercise or body-building weight-lifting apparatus, and more particularly an improved carriage for this type apparatus on which the exercise weights are suspended.

Weight-lifting apparatus is already in wide use wherein a selected weight is attached to a vertically movable carriage incident to exercising use of the apparatus. In addition to the variation afforded by the weight selection, it would also be desirable to enable the user to exercise in different positions, i.e. prone on a bench, squatting and standing. To accommodate these different positions correspondingly requires different positions in the handle attached to, and by which, the carriage of the apparatus is urged through movement. In known apparatus however, a handle position suitable for standing, for example, would impose a turning movement on the vertically tracking carriage that would result in binding, and thus detract from the effective use of the apparatus.

Broadly, it is an object of the present invention to provide an improved carriage with a vertically adjustable handle that does no bind in any handle position, and otherwise overcomes the foregoing and other shortcomings of the prior art.

Specifically, it is an object to slidably dispose a handle on a carriage for vertical adjustment therebetween, to correspondingly enable using the carriage in a variety of positions readily accommodated by a selected handle position, and wherein the carriage partakes of its ascending movement without binding and in practically friction free gliding traverses.

An exercise weight-lifting apparatus demonstrating objects and advantages of the present invention includes a pair of spaced-apart guide rods supported in a vertically oriented position. Operatively disposed for vertical ascending movement along said guide rods during exercising use of said apparatus is a rectangularly shaped carriage from which exercise weights are suspended to oppose the ascending movement of the carriage. A handle is connected to extend from the carriage in a transverse orientation to facilitate the urging or lifting of the carriage along the guide rods, said handle having a leg extending in depending relation therefrom which is adapted to be slidably received in the carriage to allow a degree of sliding movement in the handle, to thereby permit the user to exercise in prone and standing positions corresponding to whatever handle position is selected. Completing the construction of the carriage are at least four linear bearings each disposed in a cooperating corner of the carriage and in encircling relation about a guide rod, which bearings are effective to eliminate any binding of the carriage as its moves along the guide rods, despite the forces that are applied to the carriage even when the carriage handle is in a remote slidably disposed position from the carriage.

The above brief description, as well as further objects, features and advantages of the present invention, will be more fully appreciated by reference to the following detailed description of a presently preferred, but nonetheless illustrative embodiment in accordance with the present invention, when taken in conjunction with the accompanying drawings, wherein.

Figure 1:
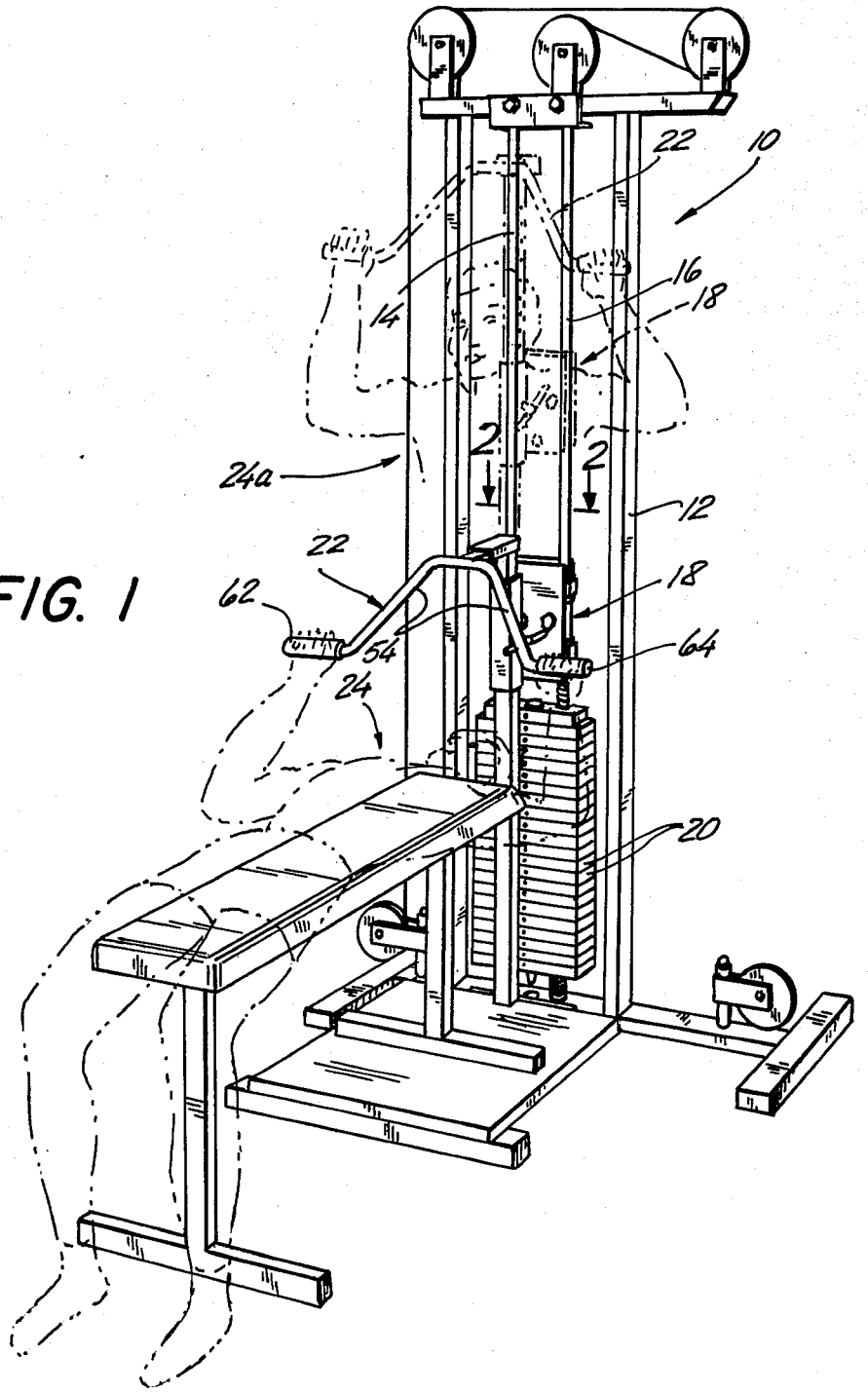
FIG. 1 is a perspective view of an improved weight-lifting apparatus according to the present invention in which prone and standing positions of the user are illustrated in phantom perspective.
Figure 2:
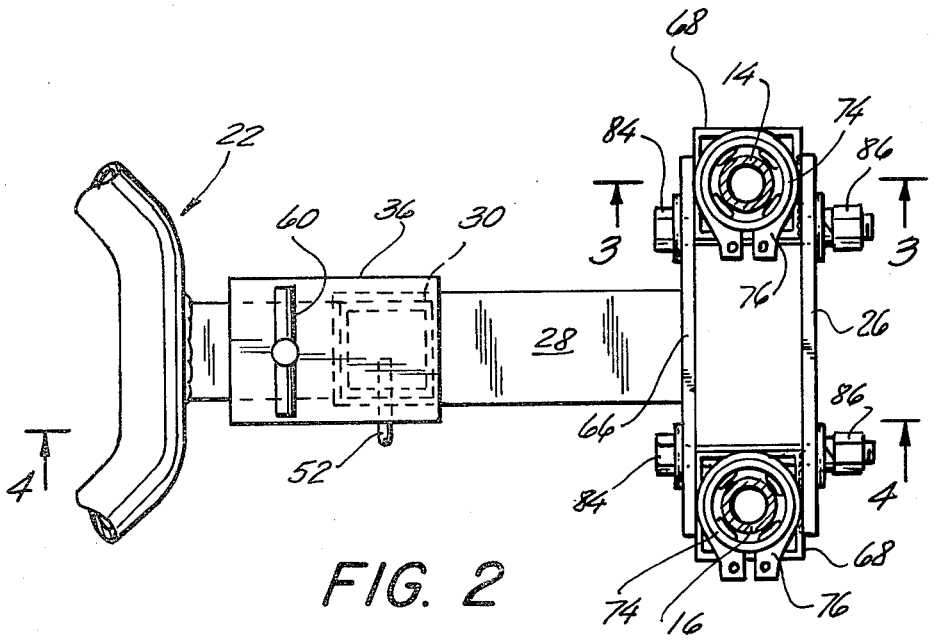
FIG. 2 is a partial plan view, as taken along line 2—2 of FIG. 1, illustrating structural details of the improved carriage of the apparatus.

As shown in FIG. 1, the within invention is concerned with a weight-lifting apparatus, generally designated 10, of the type having a frame 12 which supports a pair of spaced-apart vertically oriented guide rods 14 and 16 used for the tracking of a carriage generally designated 18, to which there is selectively attached one or more weights, individually and collectively designated 20. To enable the user to urge the carriage 18 in ascending movement along the guide rods 14 and 16, which movement is, of course, opposed by the weights 20, the carriage has suitably attached thereto, and extending substantially transversely thereof, a lifting handle 22. In the respects just generally described, apparatus 10 is similar to many models of exercising apparatus which already exist in the prior art. What distinguishes apparatus 10, and also what constitutes the within invention, is the ability to make a vertical adjustment in the handle 22 relative to the carriage 18. As a consequence of this adjustment, weights 20 can be lifted by the user or exerciser, designated 24, whether either in a prone position or in a standing position 24*a*.

Figure 5:
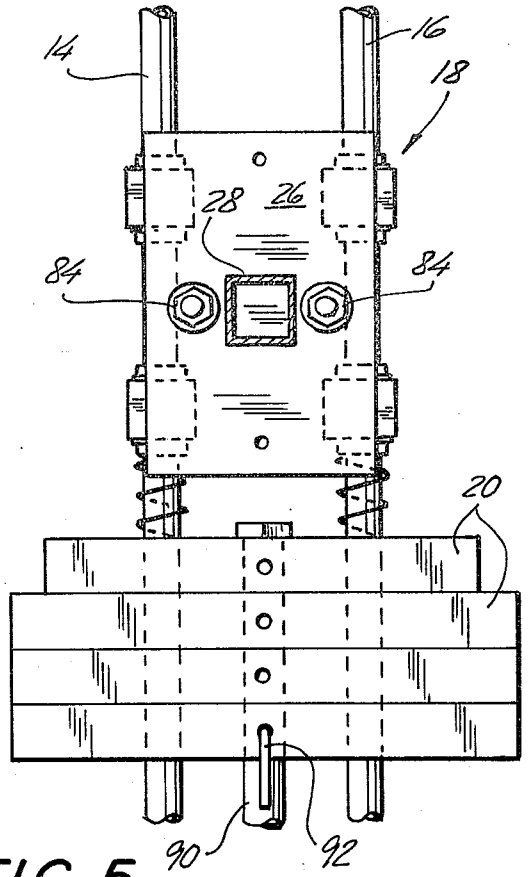
FIG. 5 is a front elevational view, as seen along line 5—5 of FIG. 4, showing structural details of the carriage.
Figure 4:
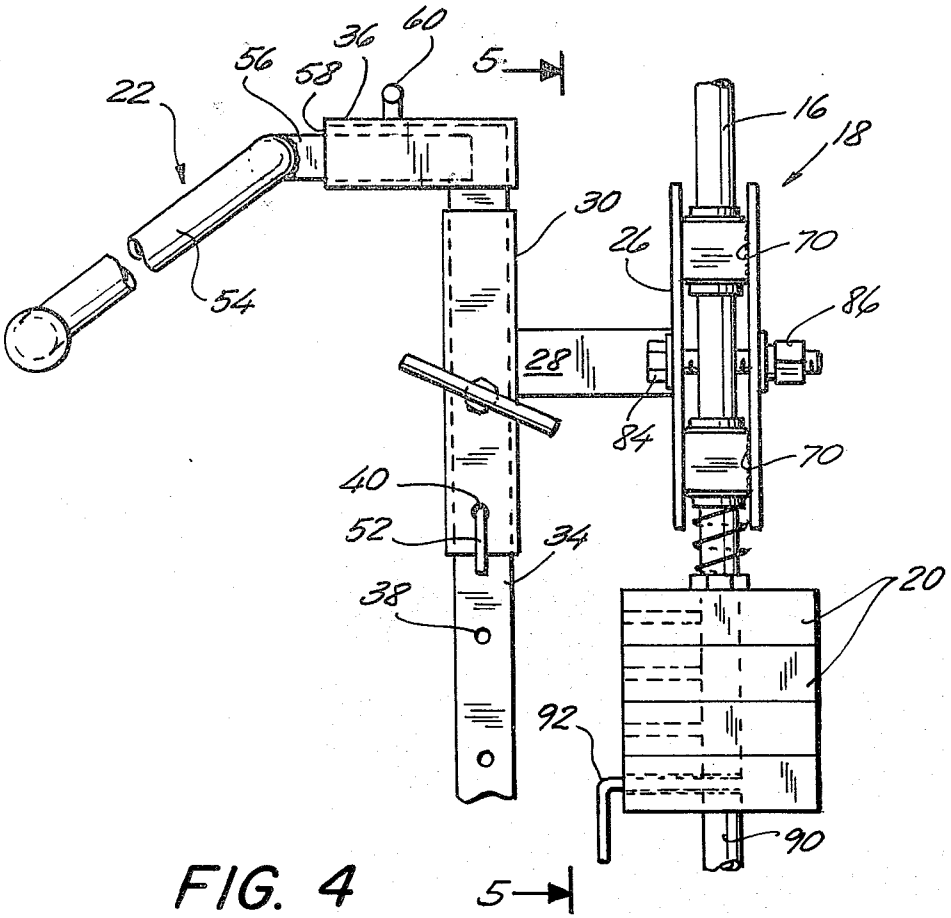
FIG. 4 is a partial side elevational view as taken along line 4—4 of FIG. 2 illustrating details of the vertically adjustable handle of the apparatus.
Figure 6:
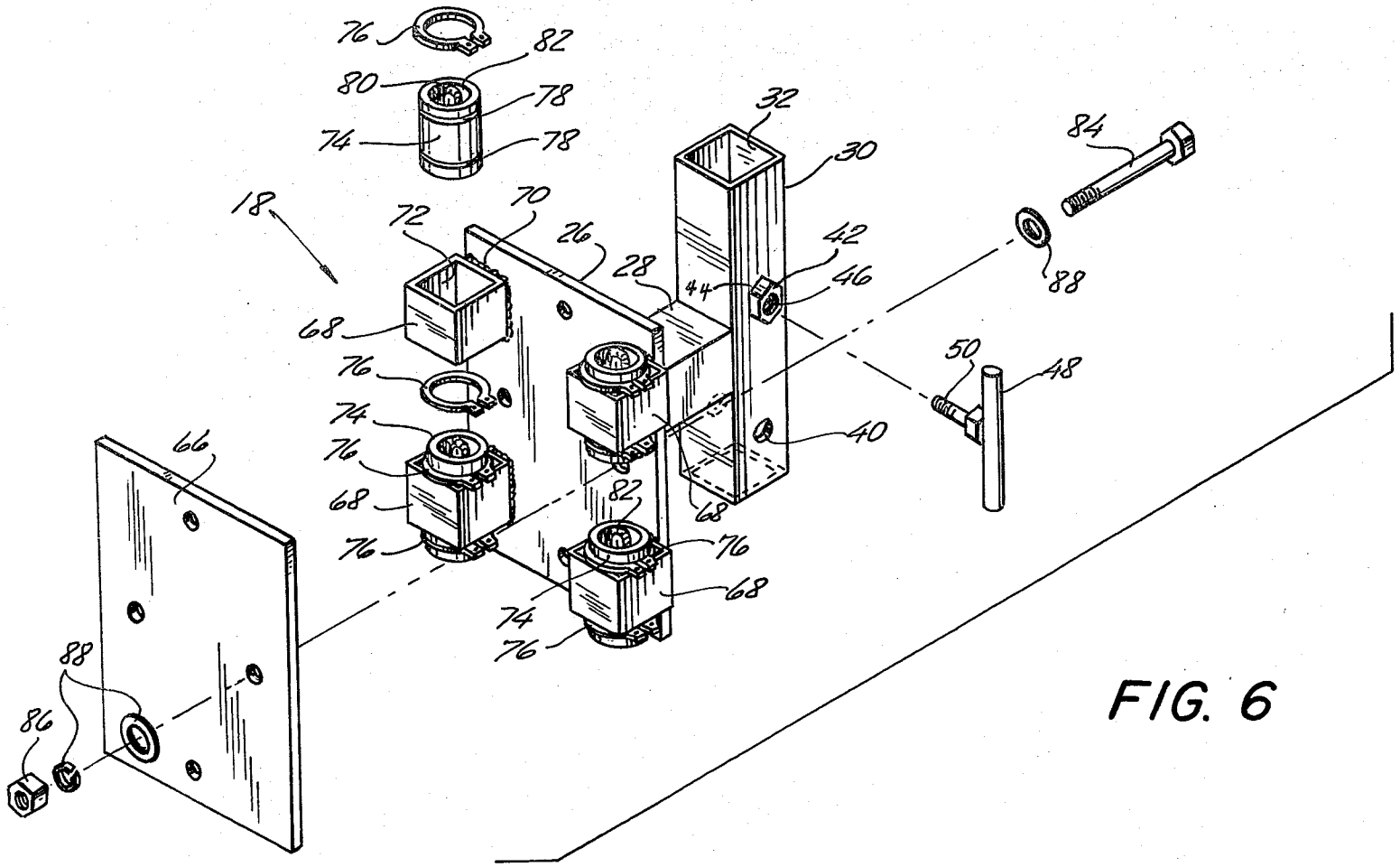
FIG. 6 is an exploded disassembled perspective view of the carriage illustrating the various structural components thereof.

The construction of the carriage 18 and of the handle 22 which allows for the vertical adjustment just noted, is readily understood from FIGS. 4–6, inclusive, to which figures reference is now made. More particularly, the vertically movable carriage 18 includes at least a front rectangular plate 26 to which there is welded or otherwise appropriately fixedly connected, a lateral extension 28 which in turn has welded to it a vertically oriented channel 30 which bounds a rectangular passageway 32. Sized to be slidably disposed in the passageway 32 is a leg 34 dependent from the handle body 36 having spaced openings 38 thereon. Adapted to have communication with the compartment 32 and thus embodied as part of the structure of the channel 30, is a nut 42 welded, as at 44, to channel 30 and having a threaded openings 46 opening into the compartment 32. As a result, the depending leg 34 of handle 22 is movable vertically within the compartment 32 and in practice such movement is made in the handle 22 to any selected elevation of the handle relative to the carriage 18. When the handle elevation is appropriate for either a squatting or standing position of the exerciser, alignment is made by eye, between the opening 40 in channel 30 and one of the openings 38 of the leg 34. To assist in establishing this alignment, it is preferred to preliminarily insert a turn screw 48 having a threaded bolt 50 into the threaded opening 46 and threadably inwardly adjust the turn screw 48 until contact is established between the bolt 50 and the side of the depending leg 44. This, of course, holds the leg 34 in place, and the exerciser is then able to insert an L-shaped pin 52, as best shown in FIG. 4, through the aligned openings 40 and 38.

Completing the description of the assembled handle construction 22, it will be noted that it includes an angled handlebar portion 54 and a centrally located projection 56 which is sized to be inserted within a compartment 58 of the handle body 36. This, of course, permits the handlebar portion 54 of handle 22 to be removed when the apparatus 10 is not in use or at least when the carriage 18 thereof is not in use. To maintain the handlebar 54 within the handle body 36 use is made of a turn screw 60 to engage with, and thus prevent the inadvertent withdrawal of the projection 56 from the compartment 58.

IMPROVED CARRIAGE

As might be recognized from the description provided thus far, when the lifting handle 22 is in its raised position with respect to the carriage 18, any lifting pressure exerted at the hand grips 62 and 64 thereof, will produce a turning movement in the carriage 18 which, in turn, could cause binding between the carriage 18 and the guide rods 14 and 16 during ascending movement of the carriage along said guide rods 14, 16. It is undoubtedly because of the possibility of binding, as just noted, that there have been no successful prior art efforts to provide a vertical adjustable handle for a tracking carriage in a weight-lifting apparatus as has been described. A significant aspect of the invention is therefore the construction of the carriage 18, now to be described in detail, which obviates any possibility of binding during the ascending movement of the carriage along guide rods 14 and 16 even in the most extreme conditions as when lifting handle 22 is adjusted to its most remote location from the carriage 18, as would be the case when the exerciser 24 contemplates using the apparatus 10 in a slightly squatting or standing position. This improved construction of the carriage 18 which obviates any binding can perhaps best be appreciated from FIG. 6 in conjunction with FIGS. 4 and 5. As shown in these figures, carriage 18 includes, in addition to a front plate 26, as already noted, a rear cooperating plate 66. Affixed to either of these plates, are bearing-holding element. In the embodiment illustrated, these bearing-holding elements, individually and collectively designated 68, are illustrated fixed, as by welding 70 to each of the four corners of the rear surface of front plate 26, the two holders to the left and right of the plate being in vertical alignment with each other. Each holder 68 bounds a compartment 72 which it will be understood is slightly oversized in relation to the diameter of a selected cooperating linar bearing 74 of the type which is readily commercially available. Four linear bearings 74 are used, each being disposed in a cooperating bearing holder 68. As illustrated, the selected linear bearing 74 is of an axial size so that the opposite ends thereof protrude out of the opposite openings of the compartment 72. C-clamps, individually and collectively designated 76, are adapted to seat in grooves 78 at opposite ends of each linear bearing 74. The C-clamps 76 are easy to install using pliers and, when seated in the grooves 78, protrude over the edges of a cooperating bearing holder 68 and thus maintain each linear bearing 74 in place.

In the sequence of assembly, each linear bearing 74 is set in place in its cooperating holder 68, thus advantageously presenting the bearings 80 thereof in an appropriate manner to minimize any friction with the guide rods 14 or 16 which, it will be understood, are disposed within the axial openings 82 of the linear bearings 74.

Figure 3:
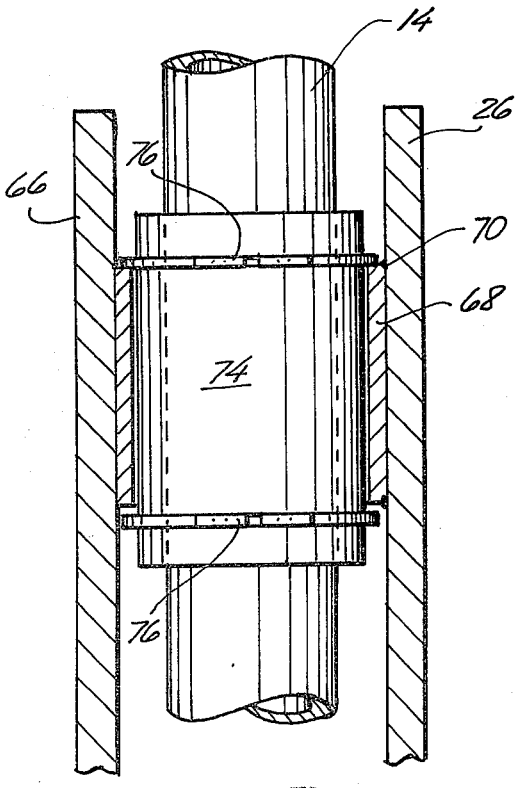
FIG. 3 is a side elevational view, on an enlarged scale, as taken along line 3—3 of FIG. 2, illustrating details in the mounting of a linear bearing of the carriage.

The assembly of the bearings 74 in encircling relation about each of the guide rods 14 and 16, are represented by FIG. 3.

The next assembly step consists of attaching the rear plate 66 to the front plate 26, this attachment being preferredly achieved by using a bolt-and-nut means 84, 86 and conventional washers 88.

In practice, it has been found that the use of linear bearings 74 in each of the four corners of the rectangular-shaped carriage 18, effectively obviates any binding during the ascending movement of the carriage 18 along guide rods 14 and 16, even though the handle 22 is spaced its maximum distance from the carriage 18 and even though any force exerted at the hand grips 62 and 64 has a tendency to cause rotation due to a turning moment in the carriage 18. Use of 4 linear bearings 74 in the strategic locations as described, thus effectively eliminate binding and guides practically friction-free carriage 18 along the guide rods 14 and 16.

Although there are many commercially available linear bearings that can be used in the construction of the improved carriage 18, the linear bearing found to be most appropriate is that designated as B-type commercially available from Thompson Industries, of Manhasset, N.Y.

The weights 20 are, of course, attached in conventional manner to the carriage 18 to oppose the ascending movement thereof and thus provide an exercising function when using the apparatus 10. For completeness' sake, and as best illustrated in FIGS. 4 and 5, it is to be noted that appropriately bolted so as to suspend from the bottom of the carriage 18 is a rod 90 having spaced openings therealong. Weights 20 each have a cooperating opening which align with the openings in rod 90. Thus, to select the number of individual weights 20 that will oppose the ascending movement of the carriage 18, the exerciser inserts an L-shaped pin 92 through the opening of the appropriate weight, making sure that the inner end of the pin also is projected within the aligning opening of the rod 90, all as is clearly illustrated in FIG. 4. As is understood, the weights 20 also track along the guide rods 14 and 16, but only those weights above the selected location for the pin 92.

A latitude of modification, change and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. An exercise weight-lifting apparatus comprising a pair of spaced-apart guide rods supported in a vertically oriented position, a rectangular shaped carriage comprised of front and rear plates operatively disposed on opposite sides of said guide rods for vertical ascending movement along said guide rods during exercising use of said apparatus, exercise weights operaively connected to oppose said ascending movement of said carriage, a vertically oriented channel member bounding a rectangular passageway on said carriage front plate, an L-shaped handle having a horizontally oriented leg adapted to extend from said carriage in a transverse orientation to facilitate the urging thereof in said ascending movement and having a depending leg extending in depending relation therefrom correspondingly rectangularly shaped and size to partake of sliding movement in said carriage rectangular passageway adapted to be slidably received in said carriage rectangular passageway for allowing a connection therebetween in a selected slidably disposed operative position of said handle for permitting the user to exercise in prone and standing positions corresponding to said handle selected operative position, a threadably adjustable means operatively effective to hold said depending leg of said handle in any selected sliding position of movement, and at least four linear bearings embodied in the construction of said carriage each disposed in a cooperating corner of said rectangular shape thereof and in encircling relation about a guide rod, whereby said bearings are effective to eliminate any binding of said carriage along said guide rods despite the forces applied to said carriage when said carriage handle is in a remote slidably disposed position therefrom.

2. A carriage for an exercise weight-lifting apparatus as claimed in claim 1, wherein the connection between the horizontally oriented leg of said handle and said depending leg is of a selectively detachable nature, whereby the handle is removable from the carriage without changing the exercising position thereof relative to said carriage.

* * * * *